US005855356A

United States Patent [19]

Fait

[11] Patent Number: 5,855,356

[45] Date of Patent: Jan. 5, 1999

[54] SANITARY TAP FOR AUTOMATIC WATER DELIVERY

[75] Inventor: Claudio Fait, Milan, Italy

[73] Assignee: American Standard, Inc., Piscataway, N.J.

[21] Appl. No.: 666,381

[22] PCT Filed: Oct. 31, 1995

[86] PCT No.: PCT/IB95/00942

§ 371 Date: Jun. 19, 1996

§ 102(e) Date: Jun. 19, 1996

[87] PCT Pub. No.: WO96/14477

PCT Pub. Date: May 17, 1996

[30] Foreign Application Priority Data

Nov. 8, 1994 [IT] Italy ..... RE94A0095

[51] Int. Cl.[6] ..... F16K 31/02; E03C 1/05

[52] U.S. Cl. ..... 251/129.04; 4/623; 236/12.12

[58] Field of Search ..... 251/129.04; 4/623; 236/12.12

[56] References Cited

U.S. PATENT DOCUMENTS

| | | | |
|---|---|---|---|
| 3,333,160 | 7/1967 | Gorski | 251/129.04 X |
| 3,576,277 | 4/1971 | Blackmon | 4/623 X |
| 4,921,211 | 5/1990 | Novak et al. | 251/129.04 |
| 5,095,945 | 3/1992 | Jensen | 251/129.04 X |
| 5,184,642 | 2/1993 | Powell | 251/129.04 X |
| 5,322,086 | 6/1994 | Sullivan | 251/129.04 X |

FOREIGN PATENT DOCUMENTS

| | | |
|---|---|---|
| 0 313 913 | 5/1989 | European Pat. Off. . |
| 0 461 349 | 12/1991 | European Pat. Off. . |
| 1609216 | 10/1969 | Germany . |
| U 85 12 039 | 7/1994 | Germany . |
| 5-287785 | 11/1993 | Japan . |
| WO 94/00645 | 1/1994 | WIPO . |

*Primary Examiner*—John Rivell

*Attorney, Agent, or Firm*—Elaine Brenner Robinson; Joseph M. Homa

[57] ABSTRACT

A tap includes a sensor (20) for determining the distance between a user's hands (3) and the tap, a mixing valve (40) regulating the temperature of water fed to delivery port (11) of the tap and a controller (30) for processing the distance values provided by the sensor. The temperature of water delivered differs based on the position of the user's hands relative to the tap.

9 Claims, 2 Drawing Sheets

SANITARY TAP FOR AUTOMATIC WATER DELIVERY

TECHNICAL FIELD

This invention relates to a sanitary tap for automatic water delivery.

BACKGROUND ART

To deliver/mix the hot and/or cold water, known taps generally require the operation of suitable control members, generally by contact with the user's hand (or foot).

Taps are also known which deliver water when the user positions his hands close to the tap, to activate a proximity sensor which determines water delivery. However such taps deliver water at only a single predetermined temperature, it not being possible to adjust the temperature other than by manually adjusting the control members (in the normal manner).

The object of the present invention is to provide a sanitary tap able to deliver water at the desired temperature without contact being required between the hands (or another part of the body) of the user and a part of the tap.

The purpose of this is to make the use of the tap more comfortable, more rapid and more hygienic.

A typical application of the tap of the invention is in washrooms open to the public (restaurants, public toilets, offices, communities, public transport, etc.) where the requirements of hygiene are particularly felt.

DISCLOSURE OF THE INVENTION

According to the invention, the tap comprises:

a sensor means for determining the distance between the tap and the user's hands;

means for regulating the temperature of the water fed to the delivery port of the tap; and means for processing the distance values provided by the sensor means and for consequently controlling the water temperature regulating means such that the temperature of the water delivered by the port 11 differs on the basis of the differing distance of the user's hands 3 from the tap.

When in use, the user positions his hands below the tap, which then delivers water at a temperature which differs in accordance with the distance between the hands and the tap.

For example, the temperature can be higher the greater this distance, or vice versa.

The user can then control the water delivery and determine its temperature simply by placing his hands at the required distance under the tap delivery port without touching any part of it.

The invention is described in detail hereinafter with the aid of the accompanying figures, which illustrate one embodiment thereof.

Figure 1:
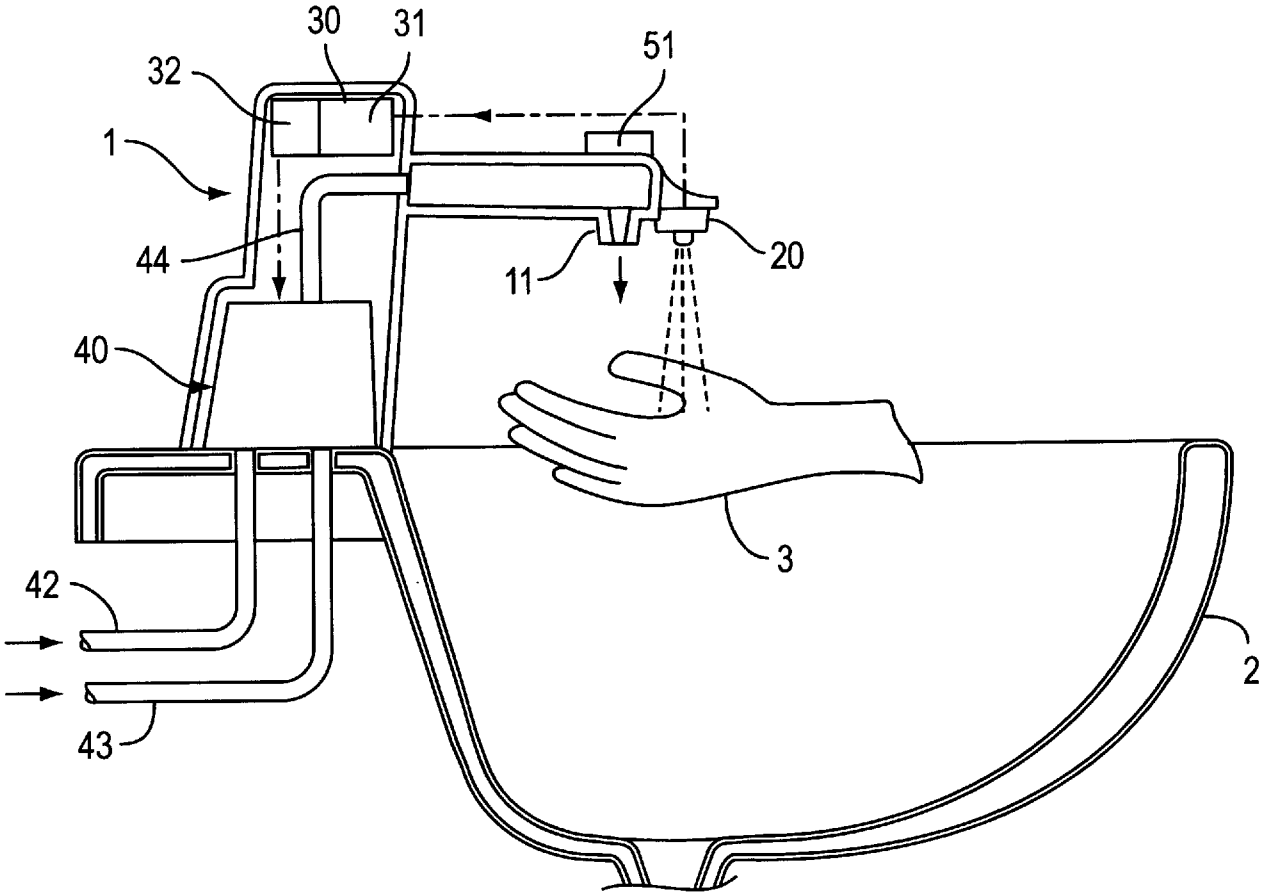
FIG. 1 is a schematic view of the tap according to the invention.

The tap of the invention, shown very schematically in FIG. 1, is indicated overall by 1 and comprises a usual water deliver port 11, and is typically positioned above a wash basin 2 in which the delivered water is collected.

With the tap 1 there is associated a sensor means 20 arranged to determine the distance of the user's hands 3 from the tap.

The sensor means 20 is positioned close to the delivery port 1 (as shown in FIG. 1), and faces the underlying wash basin 2.

The sensor means 20 can be of infrared reflecting type, or can incorporate laser diodes or ultrasound means.

The tap also comprises means 30 for processing the distance values provided by the sensor means 20.

Specifically, the means 30 comprise a microcontroller 31 which processes the information received from the sensor means 20 to implement the desired function.

The means 30 act on the temperature regulating means 40 for the water fed to the delivery port 11.

The microcontroller 31 contains software for controlling the means 40 such that the delivered temperature depends on the distance of the hands 3 from the sensor 20.

For example, the microcontroller 31 operates by dividing the space below the port 11 into several sectors and associating with each sector a respective delivered water temperature.

For example, on positioning the hands 3 within the sector nearest to the port 11, this delivers water at "cold" temperature; on positioning the hands 3 within the sector farthest from the port 11, this delivers water at "hot" temperature; finally on positioning the hands 3 within one of the intermediate sectors, the port 11 delivers water at "tepid" temperature, hot to a greater or lesser extent.

The software of the microcontroller 31 can be such as to cause the delivered water temperature to vary instantaneously as the distance of the hands 3 from the port 11 varies.

Alternatively the temperature determined by the presence of the hand 3 in any one of the sectors can be made to remain constant for a predetermined time period, even if the hands are moved into another sector. In the embodiment shown in FIG. 2, the means 40 comprise a plurality of on-off solenoid valves each connected to a source 42 feeding cold water to the tap, or to a source 43 feeding hot water to the tap.

The outlets of the valves 41 are all connected to a single exit pipe 44 in which the water is mixed and fed to the port 11.

By means of an interconnection device 32 between the microcontroller 31 and the valves 41, the opening and closure of these latter is controlled by the software of the microcontroller 31 in accordance with different combinations, with each of which there corresponds a respective mixture of hot and cold water having a respective temperature, all said temperatures being different.

Figure 2:
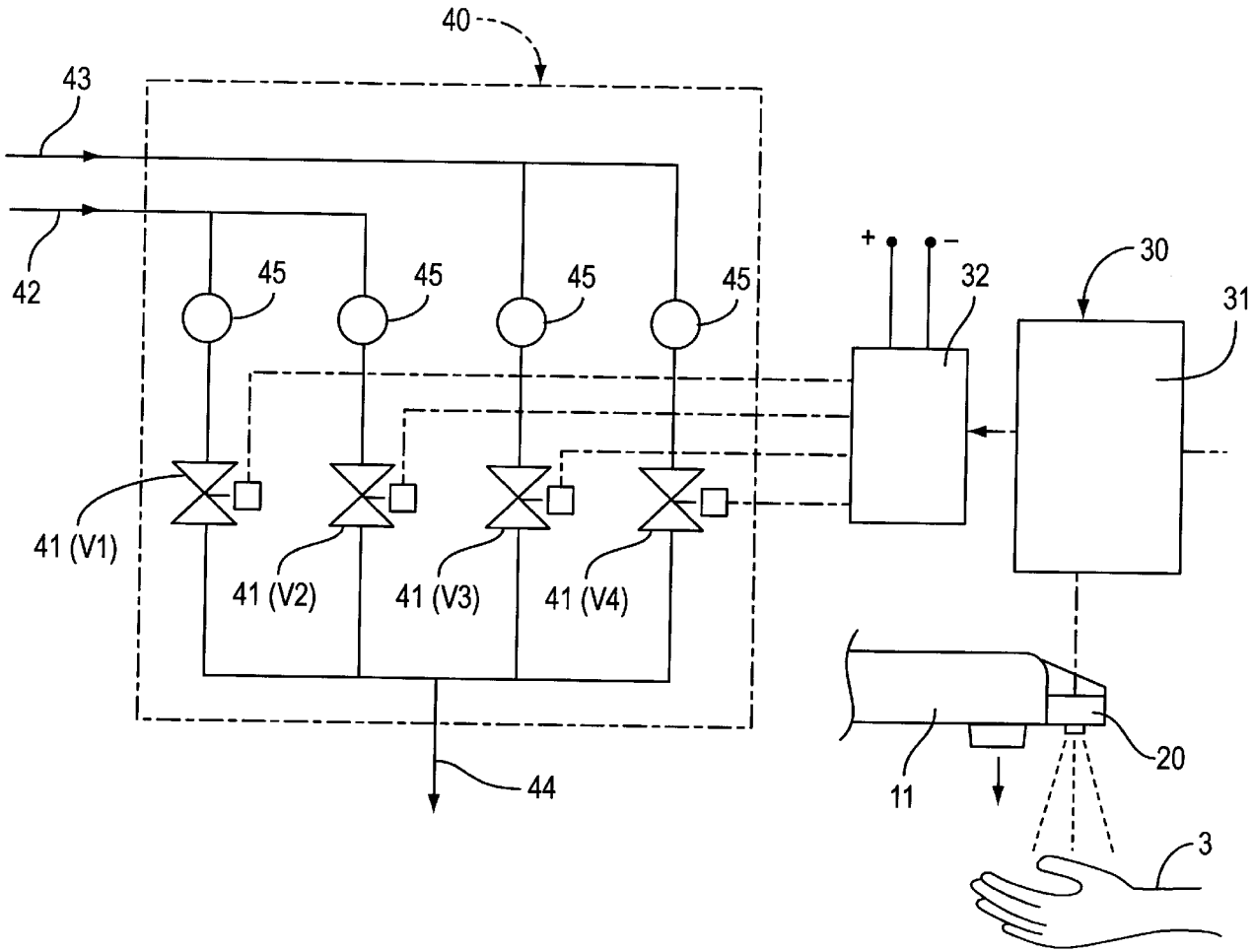
FIG. 2 is a schematic representation of one embodiment of the temperature regulating means 40.

In the embodiment shown in FIG. 2 four valves 41 are provided, with them there being associated constricting means 45 for regulating the flow rate.

Those valves 41 indicated by V1 and V2 are connected to the cold water source 42, whereas those valves 41 indicated by V3 and V4 are connected to the hot water source 43.

The constricting means 45 are adjusted such that the flow rate through the valves V2 and V4 is one half of that through the valves V1 and V3.

Hence by operating the valves V1–V4, five different combinations are obtained with five corresponding temperatures, namely a cold temperature, a hot temperature and three intermediate temperatures, plus a configuration in which the tap delivers no water, as shown in the following table:

| V1 | V2 | V3 | V4 | | |
|---|---|---|---|---|---|
| on | on | off | off | → | cold temperature, flow = 3/4 max |
| on | on | off | on | → | nearly cold temperature, flow = max |
| on | off | on | off | → | medium temperature, flow = max |
| off | on | on | on | → | nearly hot temperature, flow = max |
| off | off | on | on | → | hot temperature, flow = 3/4 max |
| off | off | off | off | → | tap closed |

In a different embodiment (not shown) of the means 40, these use proportional valves for mixing the hot and cold water together.

Further accessory means can be associated with the tap of the invention to facilitate its use.

One of these accessories is a water temperature indicator, in particular a light-emitting indicator of the delivered water temperature, positioned typically on the top of the delivery port 11 to provide signals of different colour according to the water temperature so that the user can be aware of the delivered water temperature not only by direct contact with the hands but also by sight.

A temperature sensor (not shown in the figures) for the delivered water can also be positioned such as to be grazed thereby and be arranged to close the hot water source 43 if the delivered water temperature exceeds a preset maximum value.

The regulating means 40 can be of a type different from those illustrated. They can for example comprise electrical resistance elements immersed in the water stream to the port 11, to be activated by the means 30 such as to heat the delivered water to different temperatures.

Numerous modifications of a practical and applicational nature can be made to the invention, without leaving the scope of the inventive idea as hereinafter claimed.

I claim:

1. A sanitary tap for automatic water delivery to a body part of a user comprising:

a spout provided with a delivery port;

sensor means disposed on said spout proximate said delivery port for determining a distance value corresponding to the distance between said delivery port and the body part of the user;

water temperature regulating means for regulating the temperature of the water fed through said spout to said delivery port; and processing means for processing said distance value provided by said sensor means and for controlling said water temperature regulating means in response to said distance value.

2. The sanitary tap according to claim 1 wherein said processing means divides the space below said delivery port into a plurality of sectors and associates each of said sectors with a desired delivered water temperature.

3. The sanitary tap according to claim 1 wherein said sensor means is disposed substantially adjacent said delivery port.

4. The sanitary tap according to claim 1 wherein said tap further comprises a cold water inlet and a hot water inlet;

wherein said water temperature regulating means comprises a plurality of on-off valves connected between said hot and cold water inlets and said delivery port; and wherein said processing means opens and closes said valves in different combinations, each of which corresponds to a respective hot/cold water mixture for achieving a desired delivered water temperature.

5. The sanitary tap according to claim 4 wherein said plurality of on-off valves comprise:

a first cold water valve attached to said cold water inlet;

a second cold water valve attached to said cold water inlet;

a first hot water valve attached to said hot water inlet; and a second hot water valve attached to said hot water inlet.

6. The sanitary tap according to claim 4 wherein said water temperature regulating means further comprises flow restriction means disposed between said hot and cold water inlets and said plurality of on-off valves for regulating the flow of water through said valves.

7. The sanitary tap according to claim 1 wherein said processing means is capable of directing said water temperature regulating means to turn the flow of water through said spout on and off.

8. The sanitary tap according to claim 1 wherein said sensor means detects the distance between said delivery port and the body part of the user in a direction which is substantially the same direction in which said delivery port faces.

9. The sanitary tap according to claim 1 further comprising a heater for increasing the temperature of the water which passes through said spout.

* * * * *